United States Patent [19]

Muhammad

[11] 4,230,330

[45] Oct. 28, 1980

[54] SKATEBOARD

[75] Inventor: Clifton C. Muhammad, Chicago, Ill.

[73] Assignee: Carter Bros. Iron Works, Inc., Ill.

[21] Appl. No.: 877,316

[22] Filed: Feb. 13, 1978

[51] Int. Cl.[3] ..... A63C 17/02

[52] U.S. Cl. ..... 280/87.04 A

[58] Field of Search ..... 280/87.04 R, 87.04 A, 280/11.12, 438 A, 432, 474; 272/1 R, 33 R, 46, 97, 146; 308/221, 219

[56] References Cited

U.S. PATENT DOCUMENTS

| | | | |
|---|---|---|---|
| 2,779,642 | 1/1957 | Matthews | 272/146 X |
| 3,063,739 | 11/1962 | Davies | 280/438 A |
| 3,235,282 | 2/1966 | Bostick | 280/87.04 A |
| 3,522,953 | 8/1970 | Gold | 280/87.04 R |
| 3,992,025 | 11/1976 | Amelio | 280/87.04 A |
| 4,031,988 | 6/1977 | Hill | 280/87.04 A |
| 4,040,639 | 8/1977 | Scardenzan | 280/87.04 A |

*Primary Examiner*—John J. Love
*Assistant Examiner*—Randall A. Schrecengost
*Attorney, Agent, or Firm*—Peter E. Heuser

[57] ABSTRACT

A skateboard is disclosed which has a chassis, an axle and wheel assembly, and a board, with the board extending beyond one of the axles to provide an overhanging portion. A stop pad is mounted to the underside of the skateboard in the vicinity of the overhanging portion, said stop pad generally facing the ground when the skateboard is in operational position. Therefore, by shifting weight to the overhanging portion, the rider can tilt the board, causing the stop pad to contact the ground, thereby stopping or at least slowing the skateboard. The board may be rotatably mounted to the chassis, thus allowing the rider to spin in a circle while the skateboard is following a linear course.

10 Claims, 5 Drawing Figures

FIG. 1
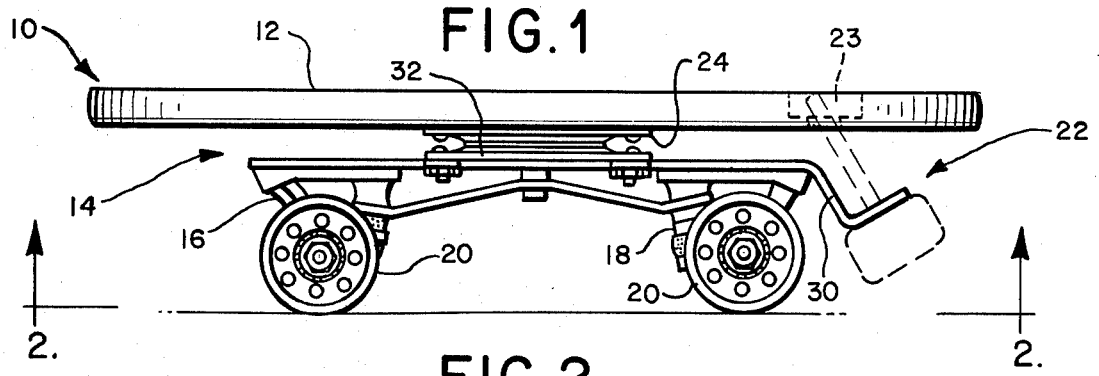
FIG. 2
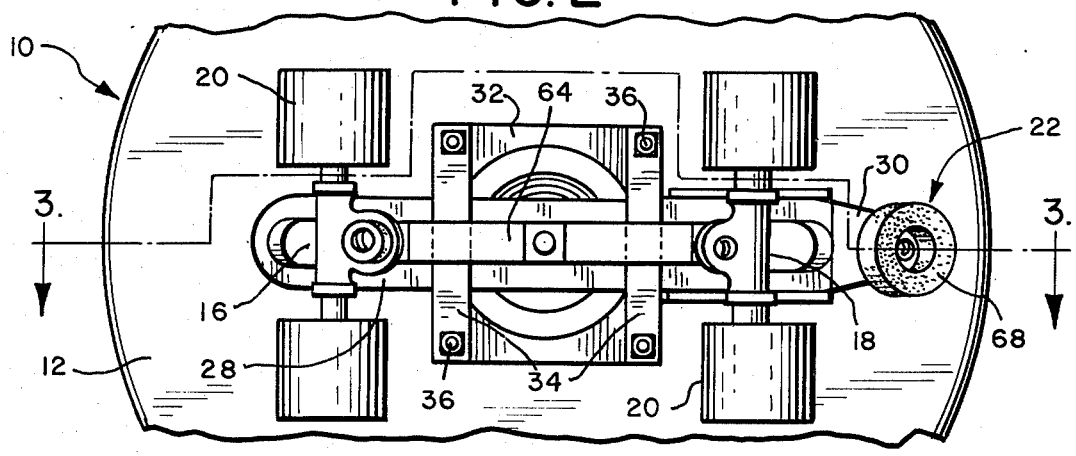
FIG. 3
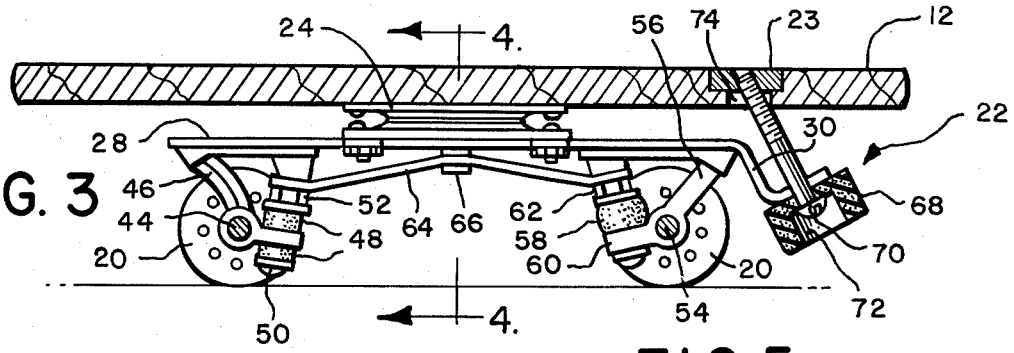
FIG. 5
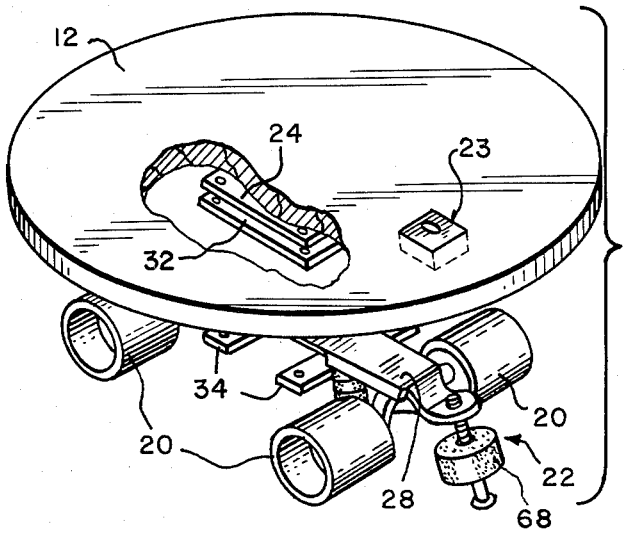
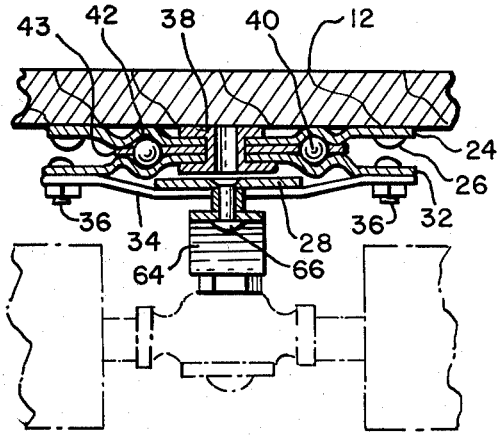
FIG. 4

SKATEBOARD

BACKGROUND OF THE INVENTION

This invention relates to skateboards. The term skateboard as used herein is intended to define a non-motorized vehicle generally used for amusement which includes a chassis having a plurality of parallel-axes wheels mounted on one side thereof, and a board mounted to the opposite side. The board, which is ordinarily elongated in shape, is adapted to support a rider. By riding down an incline or by getting a running start, the rider is able to achieve relatively high speeds, thereby challenging his balance and skill.

Until the last few years skateboard wheels were constructed of clay, which provided very little traction. Only simple maneuvers were possible on such skateboards. Appreciation of this problem led to the development of softer wheels which provide far greater traction and accompanying maneuverability. Urethane or polyurethane have been found to be most suitable. This development has resulted in a dramatic increase in the popularity of skateboarding. In fact, the high degree of maneuverability and speed attainable with this generation of skateboards has even brought about the advent of skateboard competitions and the professional skateboarder. Due to the increase in skill among such skateboarders, a need has developed for variations in the design of skateboards which provide a greater challenge.

A secondary effect of the increase in popularity of skateboarding is that increasing numbers of young people are being seriously injured on skateboards. This is at least partially due to the fact that there is no simple yet safe and effective means for stopping a skateboard.

SUMMARY OF THE INVENTION

The present invention responds to the problems presented in the prior art by providing a skateboard which includes stopping means and means by which the board may be rotatably mounted to the chassis.

Skateboards conventionally include a chassis, an axle and wheel assembly commonly called a truck, and a board. The term "board" as used herein is intended to define the surface which is mounted to the chassis, and is adapted to support the rider. This is distinguishable from the term "skateboard," which is defined above to include the entire vehicle.

In the present invention the board extends beyond at least one of the skateboard axles to provide an overhanging portion. A stop pad is mounted to the underside of the skateboard in the vicinity of the overhanging portion of said board. The stop pad generally faces the ground when the board is in an operational position. Thus, by putting weight on the overhanging portion of the board, a rider can tilt the skateboard and cause the stop pad to contact the ground. In another embodiment of the invention the board is rotatably mounted to the chassis, and may include removable locking means for fixing the rotational position of the board with respect to the chassis so that such a skateboard may also be used in a non-rotatable mode. In one preferred embodiment, the removable locking means also mounts the stop pad to the chassis.

The novel features which are believed to be characteristic of the invention are set forth in the appended claims. It is believed the invention will be best understood by reference to the following description taken in connection with the accompanying drawings in which:

FIG. 1 is a side elevation view of the skateboard showing the stop assembly in phantom;

FIG. 2 is a view showing the underside of the skateboard, taken along line 2—2 of FIG. 1;

FIG. 3 is a side elevation view taken along line 3—3 of FIG. 2;

FIG. 4 is an end view taken along line 4—4 of FIG. 3; and

FIG. 5 is an exploded perspective view of the skateboard showing the board and the mounting plates removed from the chassis.

DETAILED DESCRIPTION OF THE PREFERRED EMBODIMENTS

In one form of the invention chosen for the purpose of illustration in the figures, the skateboard is shown generally at 10. The basic components are the board 12, the chassis shown generally at 14, the front and rear trucks 16 and 18, the wheels 20, and the stop assembly shown generally at 22.

The board 12 is adapted to support a rider and is constructed of a relatively rigid material such as wood. It is also preferable that the top surface of the board provide some traction for the rider to minimize slipping. Thus, the board surface itself can be roughened, or textured tape can be fastened thereto. In the illustrated embodiment the board 12 is shown as being round in shape, although other shapes can also be utilized. One advantage of a round board is that is provides a large surface upon which the rider can maneuver. Finally, the board includes a locking nut 23, which will be discussed in detail herein below.

A first mounting plate 24 is fixed to the underside of the board 12 by suitable means, such as screws 26. This mounting plate 24 should be centered with respect to the board 12 to provide maximum stability.

The chassis 14 includes a center frame 28 which extends the length of the chassis. This center frame 28 should be relatively rigid since it supports the full weight of the rider. One end of the center frame 28 includes a stop pad support member 30, to be described in detail hereinbelow. A second mounting plate 32 is included which in the preferred embodiment is mounted to the center frame 28 by mounting straps 34. These straps 34 are secured at their ends to the second mounting plate 32 by suitable means such as the depicted bolt and nut assembly 36. As shown best in FIGS. 2 and 4, the straps 34 pass under the center frame 28, thereby rigidly fixing the center frame to the second mounting plate 32. A series of apertures (not shown) may be provided in the center frame with complementing apertures in the mounting straps to allow the mounting plate to be adjustable to various longitudinal positions along the length of the center frame, thus enabling the operator to shift the center of gravity forward or aft as desired.

The first and second mounting plates 24 and 32 are rotationally mounted to one another by the mechanism best shown in FIG. 4. A double-flanged clamp 38 maintains the mounting plates in close proximity to each other. The vertical load, however, is supported by a plurality of ball bearings 40 contained within an annular channel 42 defined by the two mounting plates. A conventional bearing retainer 43 is provided to insure that the bearings are maintained in their proper position. This bearing assembly thus allows the first mounting plate 24 and the board supported thereby to be freely rotatably with respect to the second mounting plate 32 and the skateboard chassis 14.

The skateboard wheels 20 are mounting to the center frame 28 by front and rear trucks 16 and 18. The term "truck" is intended to include an axle, a mount and a single shock absorbing assembly. Thus, as depicted in FIG. 3, the front truck 16 includes front axle 44, front mount 46, front rubbers 48, front truck stud 50 and lock nut 52. The front axle 44 is rigidly held within the truck 16. Each wheel 20 includes its own bearing assembly, which are well known in the art and therefore will not be further discussed. These bearings give the wheels the capability of being freely rotatably with respect to the axles. The front mount 46 is rigidly secured to the center frame 28 by suitable means such as rivets (not shown). The front rubbers 48 are provided to add a certain degree of shock absorbancy to the skateboard. As the name suggests, the rubbers are ordinarily constructed of rubber, but any other resilient material may also be used. The front truck stud 50 and lock nut 52 secure the rubbers 48 in place while providing a substantial degree of adjustability to the shock absorbing assembly.

The rear truck is similar to the front truck, and includes rear axle 54, rear mount 56, rear rubber 58, rear truck stud 60 and lock nut 62. The only substantial difference between the front and rear trucks is that the rear truck preferably includes a single larger rubber 58.

As shown in FIGS. 1 and 3, a center strap 64 is also included to assist in maintaining the stability of the chassis/truck assembly. This strap 64 is secured at each truck by truck studs 50 and 60, and to the center frame 28 by rivet 66.

As mentioned above, the center frame 28 includes a stop pad support member 30. In the depicted embodiment the stop pad 68 in mounted to this member by a pin or bolt 70. This bolt 70 is threadably engaged by the locking nut 23 which is rigidly held within the board 12. The stop pad 68 is typically constructed of non-metallic material such as rubber or wood. The angle and height at which member 30 supports the stop pad 68 is generally such that the lower surface of the stop pad will be parallel to the ground when the skateboard is tilted to its braking position (not shown, but discussed hereinbelow). The stop pad 68 includes an annular recessed portion 72 connected to a central opening adapted to receive the mounting bolt 70. This construction prevents the end of the bolt from contacting the ground when the stop is being used.

As mentioned above, a locking nut 23 is rigidly held within the board 12. This nut may be square or any other suitable shape as long as it is not allowed to turn within the board. The threaded aperture in the locking nut is inclined in order to receive the inclined bolt 70. The nut 23 may be of the same thickness as the board 12 or, as in the depicted embodiment, the thickness may be somewhat less, with an aligned opening 72 in the lower surface of the board. In any event, the position of the locking nut 23 should be visible from the top of the board so that when a round board is being used, the rider knows exactly where the stop pad is located.

Other mounting means may be used for mounting the stop pad 68 to the chassis 14, but the above means has been found to be particularly beneficial since it also acts as a removable locking means for fixing the rotational position of the board 12 with respect to the chassis. The term "rotational position" as used in the preceding sentence is intended to be distinguishable from the "longitudinal position" of the board which, as discussed above, may be adjustable through movement of the mounting straps 34 along the center frame 28.

It may be desirable to provide an alternate means for mounting the stop pad 68 to the chassis 14 so that the pad is maintained in place while the board is rotatable. This may be provided by a short bolt and nut (not shown) which would not extend all the way to the board. Similarly, other means may be used to lock the rotational position of the board 12 when the stop pad 68 is not in place. One method would be to provide a shorter bolt which can be mounted directly to the support member 30, extend therethrough, and be engaged by the locking nut 23 with extending above the upper surface of the board.

It can be seen in FIGS. 1 and 3 that the board 12 extends beyond the front and rear axles 44 and 54. However, in order to render the stop pad operable, it is really only necessary that the board extends beyond the axle which is adjacent to the pad. This extension should be in a direction perpendicular to the axle so that the skateboard is allowed to roll on the wheel as it is tilted to its braking position.

In operation the present skateboard offers a degree of versatility not previously attained. For example, the invention may be utilized with a simple yet effective means of braking. Alternatively, or additionally in a secondary embodiment, the board may be rotatable to provide a real challenge for even the most accomplished skateboarders. With the stop pad 68 in place and the bolt 70 engaged by the board 12, the rider can ride and maneuver as on conventional boards. To stop or slow the board, the rider shifts his weight onto the overhanging portion, which will cause the board to tilt back and the stop pad to contact the ground. The stop pad is mounted sufficiently high so that a minimal weight shift will only raise the front wheels, without necessarily causing the stop pad to contact the ground.

To remove the stop pad and render the board rotatable, a screwdriver is used to remove the bolt 70. With the skateboard in this mode, the rider is able to spin in a circle while the skateboard is following a generally linear course.

Of course, it should be understood that various changes and modifications to the preferred embodiments described herein will be apparent to those skilled in the art. Such changes and modifications can be made without departing from the spirit and scope of the present invention and without diminishing its attendant advantages. It is therefore intended that such changes and modifications be covered by the following claims.

I claim:

1. A skateboard comprising:

a chassis;

two parallel axles mounted below said chassis;

four wheels, two of which are rotatably mounted to each axle;

a board rotatably mounted to said chassis adapted to support a rider, said board extending beyond at least one of said axles to provide an overhanging portion;

a stop pad removably mounted to said chassis in the vacinity of the overhanging portion of said board, said stop pad adapted to generally face the ground when said skateboard is in an operational position; and removable locking means for fixing the rotational position of said board with respect to said chassis, said locking means also mounting said stop pad to said chassis.

2. The skateboard of claim 1 wherein said locking means is removable.

3. The skateboard of claim 1 wherein said locking means comprises a pin which is insertable through said stop pad and said chassis, and which engages said board.

4. In a skateboard of the type including a chassis with a plurality of wheels mounted thereto, said wheels having generally parallel axes, and a board mounted to the opposite side of said chassis adapted to support a rider, said board extending beyond at least one of said wheels in a direction substantially perpendicular to said axes, the improvement comprising:

a stop pad mounted to said skateboard below the extended portion of said board, said stop pad adapted to generally face the ground when said skateboard is in use but of such a height that is does not contact the ground when all of said wheels are touching the ground, so that by putting weight on said extended portion a rider can tilt said skateboard and cause said stop pad to contact the ground;

said board being rotatably mounted to said chassis so that a rider can spin in a circle while said skateboard is moving along a linear path; and locking means for mounting said stop pad to said chassis and for fixing the rotational position of said board with respect to said chassis.

5. A skateboard comprising:

a chassis;

a plurality of wheels rotatably mounted to the underside of the chassis;

a board rotatably mounted to the upper side of said chassis adapted to support a rider, said board extending beyond at least one of said wheels to provide an overhanging portion;

a stop pad mounted to said chassis in the vicinity of said overhanging portion of said board, said stop pad adapted to generally face the ground when said skateboard is in an operational position; and locking means for fixing the rotational position of said board with respect to said chassis, said locking means also mounting said stop pad to said chassis.

6. The skateboard of claim 5 wherein said board is substantially circular.

7. The skateboard of claim 5 wherein said locking means is removable, thereby permitting removal of said stop pad and rotation of said board.

8. The skateboard of claim 7 wherein said locking means includes a member which extends between said chassis and said board.

9. The skateboard of claim 8 wherein said member extends from said stop pad, through said chassis, to said board.

10. The skateboard of claim 9 wherein said member comprises a pin which is insertable through said stop pad and said chassis, and which engages said board.

* * * * *